US009887026B2

(12) United States Patent
Engels et al.

(10) Patent No.: US 9,887,026 B2
(45) Date of Patent: Feb. 6, 2018

(54) HIGH-VOLTAGE BUSHING AND METHOD FOR THE PRODUCTION THEREOF

(71) Applicant: SIEMENS AKTIENGESELLSCHAFT, Munich (DE)

(72) Inventors: Engelbert Engels, Cologne (DE); Achim Langens, Lohmar (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/310,968

(22) PCT Filed: May 12, 2014

(86) PCT No.: PCT/EP2014/059613
§ 371 (c)(1),
(2) Date: Nov. 14, 2016

(87) PCT Pub. No.: WO2015/172804
PCT Pub. Date: Nov. 19, 2015

(65) Prior Publication Data

US 2017/0084363 A1 Mar. 23, 2017

(51) Int. Cl.
*H01B 17/42* (2006.01)
*H01B 17/30* (2006.01)
(Continued)

(52) U.S. Cl.
CPC ..... *H01B 17/301* (2013.01); *H01B 17/265* (2013.01); *H01B 17/28* (2013.01); *H01B 17/303* (2013.01)

(58) Field of Classification Search
CPC ... H02G 3/24; H02G 3/30; H02G 3/36; H01B 17/42; H01B 17/00; H01B 17/005;
(Continued)

(56) References Cited

U.S. PATENT DOCUMENTS 3,962,667 A * 6/1976 Link ..... H01B 17/28 174/142
4,965,407 A * 10/1990 Hamm ..... H01B 17/26 174/142
(Continued)

FOREIGN PATENT DOCUMENTS

CN 101111907 A 1/2008
CN 101253582 A 8/2008
(Continued)

*Primary Examiner* — Angel R Estrada
(74) *Attorney, Agent, or Firm* — Laurence Greenberg; Werner Stemer; Ralph Locher

(57) ABSTRACT

A high-voltage bushing includes an insulating body disposed concentrically around a cylindrical winding support formed of electrically conductive material, and a sealing device for sealing a gap between the winding support and the insulating body. The sealing device includes a sealing element disposed in a circumferential sealing groove. The circumferential sealing groove is disposed in the winding support and accommodates the sealing element. A method for producing a high-voltage bushing includes placing an insulating body concentrically around a cylindrical winding support formed of electrically conductive material. The insulating body has mutually concentrically disposed insulating layers. A sealing element is introduced into a circumferential sealing groove in the winding support, and the insulating body is subsequently impregnated with a resin to seal a gap between the winding support and the insulating body.

8 Claims, 1 Drawing Sheet

(51) Int. Cl.
*H01B 17/28* (2006.01)
*H01B 17/26* (2006.01)

(58) Field of Classification Search
CPC .... H01B 17/26; H01B 17/265; H01B 17/301; H01B 17/34; H01B 17/56; H01B 17/28; H01B 17/16; H01B 17/303
USPC ..... 174/650, 152 R, 153 G, 152 G, 14 BH, 174/12 BH, 15.3, 142, 137 B, 143, 50.63, 174/137 R, 11 BH, 667; 16/2.1, 2.2; 248/56
See application file for complete search history.

(56) References Cited

U.S. PATENT DOCUMENTS

| | | | | |
|---|---|---|---|---|
| 7,812,266 | B2 * | 10/2010 | Rocks | H01B 17/265 174/152 R |
| 8,492,656 | B2 * | 7/2013 | Martinez | H01B 17/265 174/11 BH |
| 8,861,165 | B2 * | 10/2014 | Kampe | H01B 17/16 174/142 |
| 8,907,223 | B2 * | 12/2014 | Johansson | H01B 17/28 174/143 |
| 2008/0179077 | A1 | 7/2008 | Krivda et al. | |
| 2009/0032283 | A1 | 2/2009 | Sjoberg et al. | |

FOREIGN PATENT DOCUMENTS

| | | | |
|---|---|---|---|
| DE | 1041123 | B | 10/1958 |
| DE | 1105018 | B | 4/1961 |
| DE | 3640180 | A1 | 6/1988 |
| WO | 2011117889 | A2 | 9/2011 |

* cited by examiner

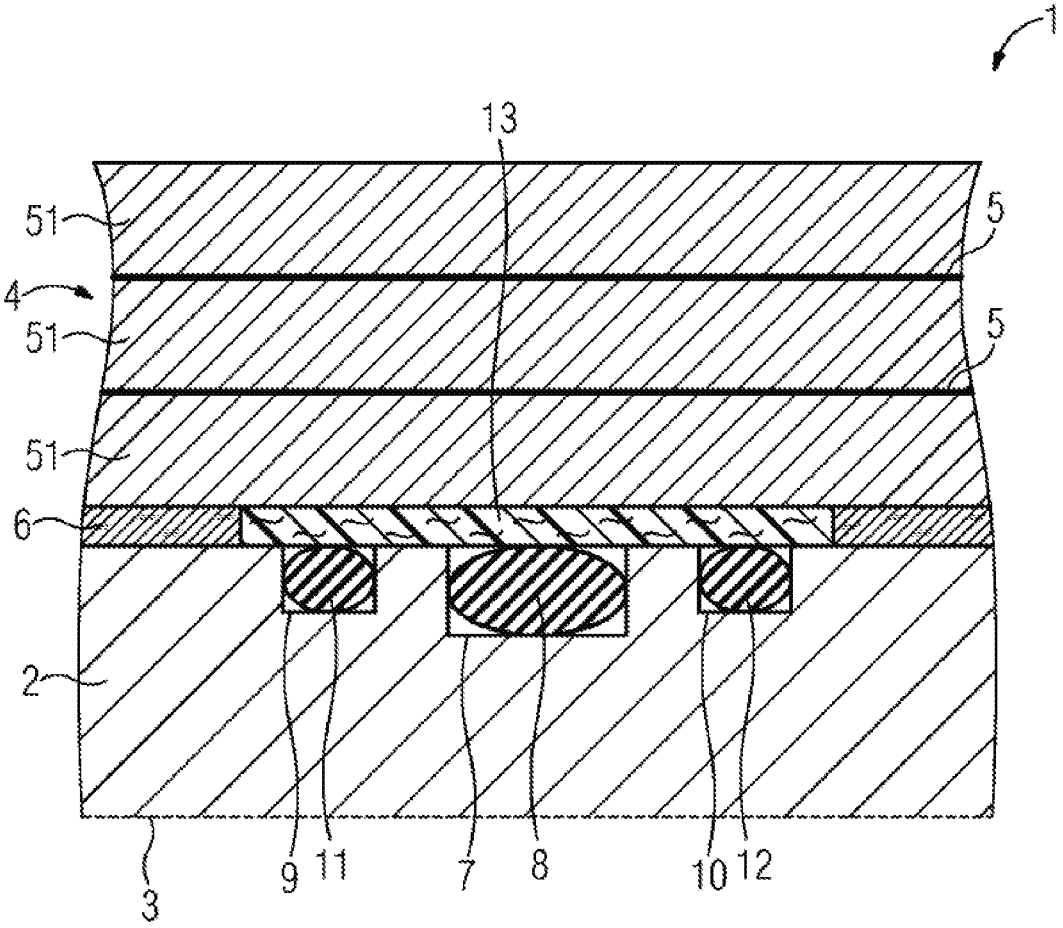
1
13
51
5
4
51
5
51
6
2
3
9
11
7
8
10
12

HIGH-VOLTAGE BUSHING AND METHOD FOR THE PRODUCTION THEREOF

BACKGROUND OF THE INVENTION

Field of the Invention

The invention relates to a high-voltage bushing comprising an insulating body, which is arranged in a concentric manner around a cylindrical winding support that is embodied from an electrically conductive material, and also comprising a sealing device for sealing a gap between the winding support and the insulating body, wherein the sealing device comprises a sealing element in a circumferential seal groove.

High-voltage bushings of this type are known from the prior art. High-voltage bushings generally have the task of insulating a high-voltage line, which is located on a high-voltage potential and comprises a current-carrying current conductor, from a wall that is located essentially on the ground potential, and the high-voltage line is to be fed through said high-voltage bushings. Said high-voltage line is by way of example a high-voltage line that is guided out of a transformer housing, wherein the transformer housing is filled with an insulating fluid, by way of example oil.

The known high-voltage bushing comprises a cylindrical winding support that can be simultaneously the current conductor. An insulating body is arranged around the winding support. A gap can form between the winding support and the insulating body and it is possible for the insulating fluid to pass into said gap, from where it can spread out along the entire winding support. The insulating fluid can also penetrate into the insulating body of the high-voltage bushing, which can lead to a failure of the entire high-voltage bushing.

In order to prevent this, a sealing device is provided in the case of the known high-voltage bushing and said sealing device comprises a sealing element in a circumferential seal groove. The seal groove of the known high-voltage bushing is worked into the insulating body in the form of a recess during the process of producing the bushing. If the high-voltage bushing is by way of example a RIP bushing, in other words a resin-impregnated high-voltage bushing, then the seal groove is milled in the impregnated and hardened insulating body in a region close to the winding support. However, this can lead to the insulating body being damaged during the subsequent milling process, which in turn can lead frequently to the entire high-voltage bushing failing during the production process. In particular, in the event that the insulating body comprises capacitive control inserts that lie in a sealing manner against one another, said control inserts can become damaged during the course of the turning process when producing the seal groove. Furthermore, such a process of producing the seal groove is complex and relatively cost-intensive.

BRIEF SUMMARY OF THE INVENTION

The object of the invention is to propose a high-voltage bushing of this type but that can be produced in a simpler and more cost-effective manner.

The object is achieved in accordance with the invention by means of a high-voltage bushing of the of the type mentioned in the introduction by virtue of the fact that the circumferential seal groove is arranged in the winding support and receives the sealing element.

The high-voltage bushing in accordance with the invention has the advantage that as a result of arranging the seal groove in the winding support, the complex process of milling the insulating body is omitted as a result of which the number of failures is reduced and it is possible to reduce the costs of producing the high-voltage bushing. Furthermore, it is possible to avoid the risk of damaging the insulating body during the milling process. In fact, the seal groove that receives the sealing element can be produced prior to attaching the insulating body to the winding support. The sealing element can be by way of example an O-ring that is inserted into the seal groove and provides a circumferential sealing arrangement.

It is preferred that the sealing device comprises moreover a sealing ring that is arranged in a concentric manner with respect to the sealing element. The sealing ring further improves the sealing arrangement because it offers a suitable sealing surface against which the sealing element can be supported. In addition, in the event that the insulating body of the high-voltage bushing is impregnated with a fluid insulating medium, the sealing ring can prevent the insulating medium from passing into the seal groove.

In order to improve the bond between the sealing ring and the insulating body, the sealing ring preferably comprises a resin, by way of example a resin mixture. If the insulating body is likewise impregnated with a resin, the sealing ring can bond with the insulating body in a particularly efficient manner on a surface that is facing the insulating body.

In accordance with one embodiment of the invention, the insulating body comprises insulating layers that are arranged in a concentric manner with respect to one another and said insulating body is impregnated with a hardenable resin. The insulating layer can be by way of example paper, such as crepe paper, or a non-woven material. The insulating layers are moreover preferably separated from one another by means of conductive control inserts. The control inserts are used so as to control the high-voltage bushing in a capacitive manner and are embodied in a suitable manner from a conductive material, by way of example aluminum. The insulating layers are wound onto the winding support during the process of producing the high-voltage bushing having the conductive control inserts. The insulating body having the wound-on insulating and control inserts is subsequently impregnated with a resin or resin mixture so that a compact block is produced once the resin mass has hardened and said compact block does not comprise any enclosed hollow spaces in the interior of the insulating body.

It is preferred that the sealing element comprises an elastic synthetic material. The advantage of using the elastic synthetic material is that the sealing element can develop a counterforce during the deformation process. If the cross-sectional diameter of the sealing element is by way of example greater than a depth of the seal groove, then the sealing element is pressed into the seal groove by means of the insulating body, wherein the sealing element is deformed. As a consequence, the sealing element exerts a counterforce on the insulating body or on the sealing ring which is arranged in a coaxial manner with respect to the sealing element, which improves the sealing arrangement.

In accordance with an advantageous embodiment of the invention, the high-voltage bushing comprises moreover a first and a second protective element for sealing the seal groove, said protective elements being arranged in a circumferential groove in the winding support, wherein the seal groove is arranged in an axial manner between the two grooves and consequently between the two protective elements. The protective elements can be embodied by way of example as elastic O-rings. The protective elements provide a sealing arrangement that prevents a fluid insulating medium from passing into the seal groove, if the insulating body of the high-voltage bushing is to be impregnated with such an insulating medium.

In accordance with a further advantageous embodiment of the invention, the winding support is embodied as a current conductor. This simplifies the process of producing the high-voltage bushing. However, it is also feasible that the current conductor is guided as a separate part through an inner space of the cylindrical winding support. An intermediate space between the current conductor and the winding support can be filled by way of example with an electrically insulating insulation material, by way of example a fluid.

Furthermore, the invention relates to a method for producing a high-voltage bushing comprising an insulating body that is arranged in a concentric manner around a cylindrical winding support that is embodied from an electrically conductive material and said insulating body comprises insulating layers that are arranged in a concentric manner with respect to one another.

Such a method is used during the process of producing the known high-voltage bushing that is described in the introduction.

The object of the invention is to propose a method for producing such a high-voltage bushing, wherein a gap between the winding support and the insulating body can be sealed in a simpler and more cost-effective manner.

The object is achieved in accordance with the invention by means of a method, wherein a sealing element is inserted in a circumferential seal groove in the winding support and the insulating body is subsequently impregnated with a resin so that the gap between the winding support and the insulating body is sealed. Accordingly, the seal groove is provided in the winding support. It is possible to insert the sealing element into the seal groove prior to impregnating the insulating body. It is thus not necessary to mechanically work the insulating body once the resin has hardened. The production process is consequently produced in a simpler manner and is more cost-effective.

It is preferred that a sealing ring is installed in a coaxial manner around the sealing element prior to impregnating the insulating body. The sealing ring cooperates with the sealing element so that as a consequence it is possible to improve the sealing arrangement.

Moreover, it is particularly preferred that in order to seal the seal groove a first and a second protective element are arranged in each case in a circumferential groove in a winding support prior to impregnating the insulating body so that the seal groove is located in an axial manner between the first and the second protective element. The additional protective elements prevent the liquid resin from passing into the seal groove during the impregnation process.

The invention is explained hereinunder with reference to the exemplary embodiment illustrated in the FIGURE.

BRIEF DESCRIPTION OF THE SEVERAL VIEWS OF THE DRAWING

The FIGURE illustrates a section of an embodiment of the high-voltage bushing 1 in accordance with the invention in a schematic cross-sectional view.

DESCRIPTION OF THE INVENTION

The FIGURE illustrates a section of a high-voltage bushing 1 in cross-section. The section of the high-voltage bushing 1 illustrated in the FIGURE comprises a winding support 2 that is embodied in a cylindrical manner. The axis of symmetry of the cylindrical winding support 2 is characterized by a broken line 3. In the illustrated exemplary embodiment of the high-voltage bushing 1, the winding support 2 is simultaneously the current conductor. An insulating body 4 is arranged in a coaxial manner about the winding support 2.

The insulating body 4 comprises control inserts 5 that are embodied from a conductive material, by way of example aluminum, so as to control the high-voltage bushing 1 in a capacitive manner. The control inserts 5 are arranged in a concentric manner and spaced apart from one another around the winding support 2. Wound-up layers of an electrically insulating material, preferably crepe paper, are located in a radial manner between the control inserts, as a consequence of which the insulating layers 51 are formed and arranged in a concentric manner with respect to one another and delimited by the control inserts.

An intermediate region 6 between the winding support 2 and the insulating body 4 is filled with an elastic cork mass that can compensate for a radial expansion of the winding support 2 with regard to the insulating body 4.

The winding support 2 comprises a seal groove 7 that is arranged in a circumferential manner in the winding support 2. A sealing element 8 in the form of an O-ring that is embodied from an elastic synthetic material is arranged in the seal groove 7. Moreover, the winding support 2 comprises a first groove 9 and a second groove 10 that are likewise arranged in a circumferential manner.

The seal groove 8 is located in an axial manner between the grooves 9 and 10. A first O-ring 11 is arranged in the first groove 9 and a second O-ring 12 is arranged in the second groove 10. The first and the second O-ring 11, 12 are protective elements that protect the seal groove 7 from a liquid resin flowing in during the process of impregnating the insulating body 4. A free space remains in this manner in the seal groove 7 between the winding support 2 and the sealing element 8 so that it is possible for the elastic sealing elements 8 to deform.

A sealing ring 13 is arranged in a coaxial manner around the seal groove 7. The sealing ring 13 comprises a paper-resin mixture so that the sealing ring 13 can easily bond with the insulating medium (in the present example resin) of the insulating body 4.

Initially, the winding support 2 is produced during the process of producing the high-voltage bushing 1. Subsequently, the grooves 9 and 10 and also the seal groove 7 are produced in the winding support. The sealing element 8 and the protective elements or O-rings 11 and 12 are then inserted into the corresponding grooves 9, 10 in the winding support 2. The sealing ring 13 is arranged in a coaxial manner around the grooves 7, 9 and 10 and subsequently the insulating layers 51 of the insulating body are wound up together with the control inserts 5 on the winding support. Finally, the insulating body 4 is then impregnated with a liquid, hardenable resin. Once the liquid resin material has hardened, a compact bushing is produced that does not require any further processing so as to seal the gap between the winding support 2 and the insulating body 4.

LIST OF REFERENCE NUMERALS

1 High-voltage bushing
2 Winding support
3 Line
4 Insulating body

5 Control inserts
51 Insulating layers
6 Intermediate region
7 Seal groove
8 Sealing element
9 Groove
10 Groove
11 Protective element
12 Protective element

The invention claimed is:

1. A high-voltage bushing, comprising:

a cylindrical winding support formed of an electrically conductive material, said cylindrical winding support having a circumferential sealing groove formed therein;

an insulating body disposed concentrically around said cylindrical winding support; and a sealing device for sealing a gap occurring between said cylindrical winding support and said insulating body, said sealing device including a sealing element received in said circumferential sealing groove, and said sealing device including a sealing ring disposed concentrically relative to said sealing element.

2. The high-voltage bushing according to claim 1, wherein said sealing ring contains resin.

3. The high-voltage bushing according to claim 1, wherein said insulating body includes insulating layers disposed concentrically relative to one another, and said insulating body is impregnated with a hardenable resin.

4. The high-voltage bushing according to claim 1, wherein said sealing element contains an elastic synthetic material.

5. The high-voltage bushing according to claim 1, wherein said cylindrical winding body is a current conductor.

6. A high-voltage bushing, comprising:

a cylindrical winding support formed of an electrically conductive material, said cylindrical winding support having a circumferential sealing groove formed therein, and said cylindrical winding support having circumferential grooves formed therein:

an insulating body disposed concentrically around said cylindrical winding support;

a sealing device for sealing a gap occurring between said cylindrical winding support and said insulating body, said sealing device including a sealing element received in said circumferential sealing groove;

first and second protective elements sealing said sealing groove;

said protective elements each being disposed in a respective one of said circumferential grooves formed in said cylindrical winding support; and said sealing groove being disposed axially between said first and second protective elements.

7. A method for producing a high-voltage bushing, the method comprising the following steps:

forming a circumferential sealing groove in a cylindrical winding support formed of an electrically conductive material;

providing an insulating body having mutually concentrically disposed insulating layers;

placing the insulating body concentrically around the cylindrical winding support;

inserting a sealing element into the circumferential sealing groove in the cylindrical winding support;

placing a sealing ring coaxially around the sealing element; and subsequently impregnating the insulating body with a resin to seal a gap occurring between the cylindrical winding support and the insulating body.

8. A method for producing a high-voltage bushing, the method comprising the following steps:

forming a circumferential sealing groove in a cylindrical winding support formed of an electrically conductive material;

forming circumferential grooves in the cylindrical winding support;

providing an insulating body having mutually concentrically disposed insulating layers;

placing the insulating body concentrically around the cylindrical winding support;

inserting a sealing element into the circumferential sealing groove in the cylindrical winding support;

sealing the sealing groove by placing first and second protective elements in the respective circumferential grooves formed in the cylindrical winding support;

subsequently impregnating the insulating body with a resin to seal a gap occurring between the cylindrical winding support and the insulating body; and locating the sealing groove axially between the first and second protective elements.

* * * * *